US005536697A

United States Patent [19]

Hada et al.

[11] Patent Number: 5,536,697

[45] Date of Patent: Jul. 16, 1996

[54] THERMAL PRINTING MATERIAL FOR PROVIDING IMPROVED IMAGE RELIABILITIES

[75] Inventors: Kunihiko Hada, Numazu; Motoo Tasaka, Susono; Shuji Miyamoto, Numazu, all of Japan

[73] Assignee: Ricoh Company, Ltd., Tokyo, Japan

[21] Appl. No.: 356,128

[22] Filed: Dec. 15, 1994

[30] Foreign Application Priority Data

| | | | |
|---|---|---|---|
| Dec. 16, 1993 | [JP] | Japan | 5-343484 |
| Dec. 18, 1993 | [JP] | Japan | 5-344171 |
| Dec. 9, 1994 | [JP] | Japan | 6-331854 |

[51] Int. Cl.[6] ..... B41M 5/30; B41M 5/40

[52] U.S. Cl. ..... 503/207; 503/216; 503/225; 503/226

[58] Field of Search ..... 427/150; 503/216, 503/225

[56] References Cited

U.S. PATENT DOCUMENTS

| | | | |
|---|---|---|---|
| 5,444,036 | 8/1995 | Iwasaki et al. | 503/209 |

FOREIGN PATENT DOCUMENTS

| | | | |
|---|---|---|---|
| 0251209 | 1/1988 | European Pat. Off. . | |
| 0252691 | 1/1988 | European Pat. Off. . | |
| 0147388 | 8/1985 | Japan | 503/216 |

OTHER PUBLICATIONS

Patent Abstracts of Japan, vol. 17, No. 12 (M–1351), Jan. 11, 1993, JP–A–04 241987, Aug. 28, 1992.

Patent Abstracts of Japan, vol. 17, No. 565 (M–1495), Oct. 13, 1993, JP–A–05 162458, Jun. 29, 1993.

Patent Abstracts of Japan, vol. 8, No. 182 (M–319) [1619], Aug. 22, 1984, JP–A–59 073991, Apr. 26, 1984.

*Primary Examiner*—B. Hamilton Hess

*Attorney, Agent, or Firm*—Oblon, Spivak, McClelland, Maier & Neustadt

[57] ABSTRACT

A thermal printing material having a substrate and a recording layer on the substrate, the recording layer containing a leuco compound color and a developer for developing the leuco compound color when heated, the developer comprising a compound represented by the formula:

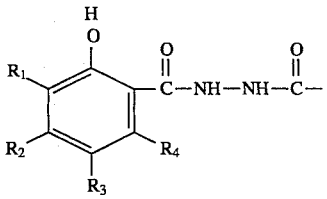

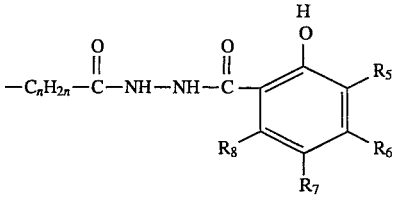

wherein each of R1 through R8 indicates a hydrogen atom or an alkyl group having from 1–5 carbon atoms, and n indicates an integer from 6–14.

8 Claims, No Drawings

THERMAL PRINTING MATERIAL FOR PROVIDING IMPROVED IMAGE RELIABILITIES

BACKGROUND OF THE INVENTION

The present invention generally relates to a thermal printing material, and more particularly to a thermal printing material which can provide a highly reliable printed image, the reliabilities of the printed image involving a light resistance, a water resistance, a heat resistance and a chemical resistance.

The research and development of thermal printing materials becomes active so as to meet the progress of information processing technology and the increasing needs of the market. This is because the thermal printing materials have advantageous features: that is, (1) a process of heating the thermal printing material can easily realize an image printing; (2) an image printing apparatus using the thermal printing material can be easily built in a simple and compact form; and (3) the thermal printing materials are inexpensive and easy to use.

The technology of thermal printing materials is applied in various manners to information processing, medical measurement electronics, facsimile communications, copiers and printers, point-of-sales systems, and the like. The recent demands in these fields for a thermal printing material to provide a more reliable recorded image are increasing.

In order to improve the image printing reliabilities of heat sensitive materials, various kinds of developers for use in the heat sensitive materials have been proposed by the following prior art:

p-toluensulfonilhydrazide
(Japanese Laid-Open Patent Application No.62- 294590)
hydroxynaphthoic acid derivatives
(Japanese Laid-Open Patent Application No.63- 28691)
1,4-bis(β-2,4-dihydroxybenzoyloxyethoxycarbonyl)benzene
(Japanese Laid-Open Patent Application No.63- 72590)
salicylic acid derivatives
(Japanese Laid-Open Patent Application No.1- 168486)

However, any of the conventional thermal printing materials mentioned above have not had image printing reliabilities sufficiently high to meet the recent demands. The heat resistance, light resistance, water resistance, and chemical resistance of the conventional thermal printing materials have been insufficient.

SUMMARY OF THE INVENTION

Accordingly, it is a general object of the present invention to provide a novel and useful thermal printing material in which the above described problems are eliminated.

Another, more specific object of the present invention is to provide a thermal printing material which provides a highly reliable printed image and an excellent image quality.

Still another object of the present invention is to provide a thermal printing material which provides a printed image which is highly resistant to light, such as sun light or fluorescent light, even when exposed to light for a long time.

A further object of the present invention is to provide a thermal printing material which provides a printed image which is highly resistant to heat, wherein a defect, such as a fog, in the printed image is unlikely to appear even when the thermal printing material is placed under a condition above 100° C.

Another object of the present invention is to provide a thermal printing material which provides a printed image which is highly resistant to water and chemicals.

The above mentioned object of the present invention is achieved by a thermal printing material having a substrate and a recording layer on the substrate, the recording layer comprising a leuco compound color and a developer for developing the leuco compound color when heated, the developer comprising a compound represented by the formula:

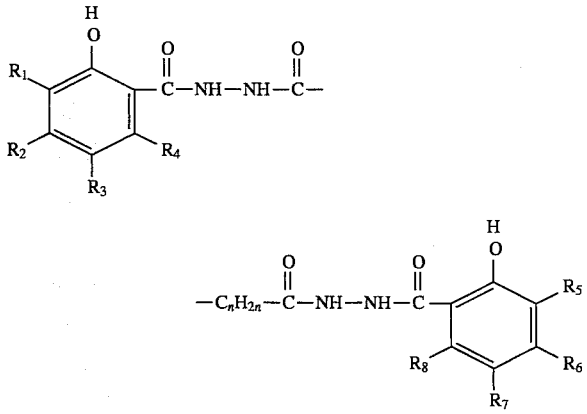

wherein each of R1 through R8 indicates a hydrogen atom or an alkyl group having from 1–5 carbon atoms, and n indicates an integer from 6–14.

According to the present invention, the thermal printing material can provide a printed image which is more resistant to heat, light, water and alcohol in comparison with the conventional thermal printing materials.

Other objects, features and advantages of the present invention will be more apparent from the following detailed description.

DESCRIPTION OF THE PREFERRED EMBODIMENTS

A description will now be given of the thermal printing material according to the present invention.

After detailed studies on the thermal printing material have been performed, it is discovered that a developer, contained in a recording layer of a thermal printing material, which comprises a compound represented by the formula:

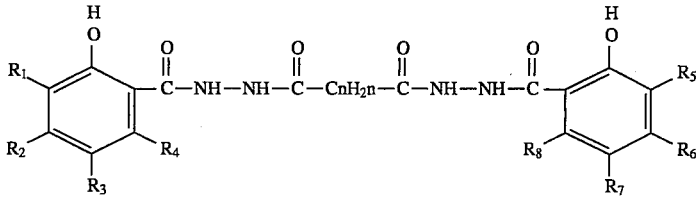

(I)

wherein each of R1 through R8 indicates a hydrogen atom or an alkyl group having from 1–5 carbon atoms, and n indicates an integer from 6–14, is remarkably effective to achieve the above-mentioned objects of the present invention.

Examples of the compound represented by the above formula (I) are:

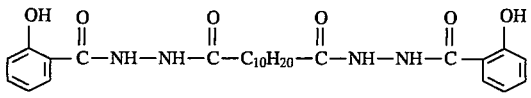

(II)

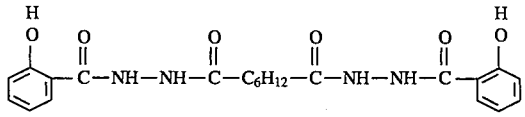

(III)

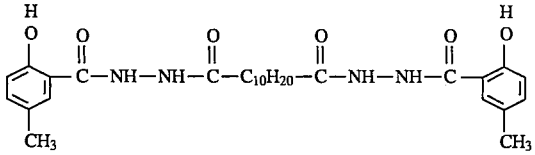

(IV)

The weight ratio of the above compound to the leuco compound color in the recording layer of the thermal printing material according to the present invention is 0.5–7 parts by weight the above compound to one part by weight the leuco compound color. It is found that the ratio of the above compound to the leuco compound color, which is 1–5 parts by weight per part the leuco compound color, is preferable for use in the recording layer of the thermal printing material.

Since the thermal printing material of this kind is heated around 120° C. when packaged with, for example, a heat-shrinkage film, the conventional thermal printing materials are likely to incur a fog in the background area thereof. However, the thermal printing material according to the present invention does not incur a fog in the background area of a printed image even when heated around 120° C. because it is highly resistant to heat.

The conventional thermal printing materials are likely to incur a fog when it contacts alcohol. However, the thermal printing material according to the present invention hardly incurs a fog when it contacts alcohol since it is highly resistant to chemicals. Therefore, the thermal printing material according to the present invention is suitable for use in medical measurement electronics wherein the thermal printing material is often exposed to chemicals.

After further studies on the thermal printing material have been performed, it is found that a thermal printing material having a substrate, an intermediate layer on the substrate, and a recording layer on the intermediate layer, the intermediate layer containing hollow particles of non-cellular plastic which have an average grain diameter from 2–10 μm and a hollow space ratio above 90 percent, and the recording layer further comprising a specific phenol compound, is remarkably effective to achieve the above-mentioned objects of the present invention.

The above phenol compound of the thermal printing material according to the present invention is represented by the formula:

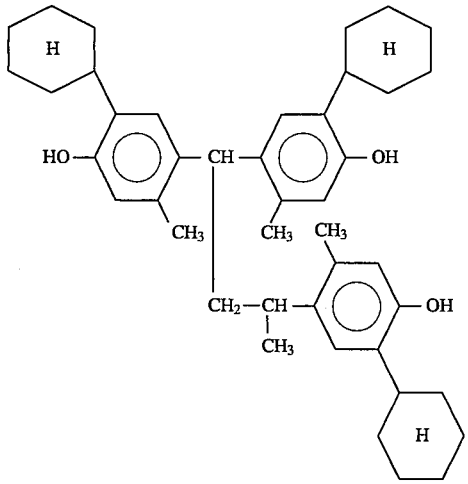

(V)

Alternatively, the above phenol compound of the thermal printing material according to the present invention is represented by the formula:

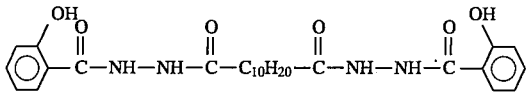

(VI)

The recording layer of the thermal printing material according to the present invention has a static color development start temperature from 100°–150° C.

The above intermediate layer of the thermal printing material according to the present invention is highly adiabatic and provides an excellent adherence to a thermal head. Therefore, the thermal printing material of the present invention can provide an increased dynamic color development sensitivity through the effective use of thermal energy from the thermal head and through the excellent adherence to the thermal head.

The above hollow particles of non-cellular plastic, contained in the intermediate layer, are very small, hollow particles which are composed of a core or shell of thermoplastic resin and contain air or the other gas in their internal space. The hollow particles have an average grain diameter from 2–10 μm. It is found that hollow particles having an average grain diameter from 3–5 μm is preferable for use in the intermediate layer of the thermal printing material of the present invention.

When the average grain diameter of the hollow particles described above is smaller than 2 μm, it is difficult to realize a desired hollow space ratio, and the cost of manufacture is high. When the average grain diameter is greater than 10 μm, the adherence to the thermal head becomes excessively low, and it is difficult to provide an increased dynamic color development sensitivity.

The above hollow particles of non-cellular plastic, contained in the intermediate layer, has a hollow space ratio above 90 percent. It is found that hollow particles having a hollow space ratio above 95% percent is preferable for use in the intermediate layer of the thermal printing material of the present invention.

The above hollow space ratio is a ratio of hollow particle inner diameter to hollow particle outer diameter, and it is represented by the formula:

$$\textit{Hollow Space Ratio} = (\textit{Inner Diameter}/\textit{Outer Diameter}) \times 100\ (\%).$$

When the hollow space ratio of the hollow particles described above is less than 90%, the intermediate layer is not highly adiabatic, and it is difficult to provide an increased dynamic color development sensitivity through the use of thermal energy from a thermal head. When a thermal printing material having such an intermediate layer is used, the thermal energy from the thermal head is likely to be transferred to the recording layer through the substrate.

Examples of the above thermoplastic resin used in the hollow particles of the intermediate layer are polystyrene, polyvinyl chloride, polyvinylidene chloride, polyvinyl acetate, polyacrylic ester, polyacrylonitrile, polybutadiene, and various copolymers of these resins. It is found that a thermoplastic resin comprising a vinylidene chloride/acrylonitrile copolymer is preferable for use in the hollow particles of the intermediate layer.

A typical method of forming the above intermediate layer on the substrate is as follows. The above hollow particles are dispersed in water with a binder such as a known water-soluble high polymer or water-soluble high polymer emulsion. The mixture of the hollow particles and the binder is applied to the substrate surface, and it is dried so as to form the intermediate layer on the substrate. The amount of the applied hollow particles must be at least 0.5 grams per square meter of the substrate surface. 1–15 grams of the hollow particles per square meter of the substrate surface is preferable. The amount of the applied binder resin must be adequate to strongly bind the intermediate layer onto the substrate. Normally, 10–75% by weight the binder resin to the total weight of the hollow particles and the binder resin is adequate.

Examples of the above water-soluble high polymer used as the binder resin are polyvinyl alcohol, starch and its derivatives, methoxycellulose, hydroxyethylcellulose, carboxymethylcellulose, methylcellulose, ethylcellulose, sodium polyacrylate, polyvinylpyrrolidone, acrylamido/acrylic ester coplymer, acrylamido/acrylic ester/methacrylic acid ternary coplymer, styrene/maleic anhydride coplymer alkali, polyacrylamido, sodium alginate, gelatine, casein and the like.

Examples of the above water-soluble high polymer emulsion used as the binder resin are styrene/butadiene/acrylic acid copolymer latex, vinylacetate resin, vinylacetate/acrylic acid copolymer, styrene/acrylic ester copolymer, acrylic ester resin, polyurethane resin and the like.

In addition, the intermediate layer of the thermal printing material of the present invention further comprises a supplementary additive when required. Examples of the supplementary additive are fillers, thermo-fusible matter, surface-active agent and the like. More specific examples of the fillers and the thermo-fusible matter will be described later in conjunction with the recording layer.

The surface of the intermediate layer after the above forming method is performed is still rough. It is desirable to make the intermediate layer surface smooth by performing a calendering process after the intermediate layer on the substrate is formed.

In order to prevent a fog in the background area of the thermal printing material from occurring under a high temperature condition, a preferable static color development start temperature of the thermal printing material is 100°–150° C. When the static color development start temperature is below 100° C., the thermal printing material is likely to incur a fog in the background area. When the static color development start temperature is above 150° C., the dynamic color development sensitivity becomes poor.

The color development start temperature described above is a temperature at which a density of a printed image, measured by use of Macbeth illuminometer RD-914, reaches 0.2 when a heat block is brought into contact with the thermal printing material for 1.0 second under pressure of 2 kg per square centimeter by use of a thermal tester from Toyo Seiki Company in Japan.

In order to ensure an excellent water resistance and light resistance, it is necessary that the recording layer of the thermal printing material further comprises a phenol compound represented by the above formula (V) or the above formula (VI). The melting points of the phenol compounds represented by the formula (V) and the formula (VI) are respectively 215° C. and 212° C. The recording layer of the thermal printing material comprising any of these phenol compounds is highly resistant to heat and water.

The leuco compound color, contained in the recording layer of the thermal printing material of the present invention, is known in the art. One leuco compound color or a mixture of two or more kinds of leuco compound colors may be applied to the recording layer of the thermal printing material of this type. Generally, a triphenylmethane base color, a fluorine base color, a phenothiazine base color, an auramine base color, a spiropyrane base color, an indolynophthalide base color and the like are preferable for the leuco compound color of the thermal printing material.

Examples of the leuco compound color, contained in the recording layer of the thermal printing material, are:

3,3-bis(p-dimethylaminophenyl)-phthalide,
3,3-bis(p-dimethylaminophenyl)-6 -dimethylaminophthalide,
3,3-bis(p-dimethylaminophenyl)-6 -diethylaminophtalide,
3,3-bis(p-dimethylaminophenyl)-6 -chlorophtalide,
3,3-bis(p-dibutylaminophenyl)-phthalide,
3-cyclohexylamino-6-chlorofluorane,
3-dimethylamino-5,7-dimethylfluorane,
3-N-methyl-N-isobuthyl-6-methyl-7 -anilinofluorane,
3-N-ethyl-N-isoamil-6-methyl-7-anilinofluorane,
3-diethylamino-7-chlorofluorane,
3-diethylamino-7-methylfluorane,
3-diethylamino-7,8-benzfluorane,
3-diethylamino-6-methyl-7-chlorofluorane,
3-(N-p-tolyl-N-ethylamino)-6-methyl-7-anilinofluorane,
3-pyrolidino-6-methyl-7-anilinofluorane,
2-{N-(3'-trifluoromethylphenyl)amino}-6-diethylaminofluorane,
2-{3,6-bis(diethylamino)-9-(o-chloroanilino)-xanthylactambenzoate,
3-diethylamino-6-methyl-7 -(m-trichloromethylanilino)fluorane,
3-diethylamino-7-(o-chloroanilino)fluorane,
3-dibutylamino-7-(o-chloroanilino)fluorane,
3-N-methyl-N-amylamino-6-methyl-7 -anilinofluorane,
3-N-methyl-N-cyclohexilamino-6-methyl-7 -anilinofluorane,
3-diethylamino-6-methyl-7-anilinoflurane,
3-diethylamino-6-methyl-7-(2',4' -dimethylanilino)fluorane,
3-(N,N-diethylamino)-5-methyl-7-(N,N-dibenzilamino)fluorane,
benzoylleucomethyleneblue, 6'-chloro-8'-methoxy-benzoindolyno-spiropylane,
6'-buromo-3'-methoxy-benzoindolyno-spiropylane,
3-(2'-hydroxy-4'-dimethylaminophenyl)-3 -(2'-methoxy-5'-chlorophenyl)phthalide,
3-(2'-hydroxy-4'-dimethylaminophenyl)-3-(2'-methoxy-5'-nitrophenyl)phthalide,
3-(2'-hydroxy-4'-dimethylaminophenyl)-3 -(2'-methoxy-5'-methylphenyl)phthalide,
3-(2'-methoxy-4'-dimethylaminophenyl)-3 -(2'-hydroxy-4'-chloro-5'-methylphenyl)phthalide,
3-morpholino-7-(N-propyltrifluoromethylanilino)fluorane,
3-pyrolidino-7-trifluoromethylanilinofluorane,
3-diethylamino-5-chloro-7-(N-benzyltrifluoromethylanilino)fluorane,
3-pyrrolidino-7-di-p-chlorophenyl)methylaminofluorane,
3-diethylamino-5-chloro-7-(α-phenylethylaminofluorane,
3-(N-ethyl-p-toluidino)-7-(α-phenylethylaminofluorane,
3-diethylamino-7-(o-methoxycarbonylphenylamino)fluorane,
3-diethylamino-5-methyl-7-(α-phenylethylamino)fluorane,
3-diethylamino-7-piperidinofluorane,
2-chloro-3-(N-methyltoluidino)-7-(p-n-buthylanilino)fluorane,
3-(N-methyl-N-isopropylamino)-6 -methyl-7-anilinofluorane,
3-dibuthylamino-6-methyl-7 -anilinofluorane,
3,6-bis(dimethylamino)fluorenespiro-( 9,3')-6'-dimethylaminophthalide,
3-(N-benzyl-N-cyclohexylamino)-5,6 -benzo-7-α-naphthylamino-4'-buromofluorane,
3-diethylamino-6-chloro-7-anilinofluorane,
3-N-ethyl-N-(2-ethoxypropyl)amino-6 -methyl-7-anilinofluorane,
3-N-ethyl-N-tetrahydrofurfurylamino-6 -methyl-7-anilinofluorane,
3-diethylamino-6-methyl-7-mesidino-4'-5'-benzofluorane,
3-(p-dimethylaminophenyl)-3-{1,1 -bis-(p-dimethylaminophenyl)ethylene- 2-il}phthalide,
3-(p-dimethylaminophenyl)-3-(1 -p-dimethylaminophenyl-1-phenylethylene- 2-il)-6-dimethylaminophthalide,
3-(p-dimethylaminophenyl)-3-(1 -p-dimethylaminophenyl-1-phenylthylene- 2-il)phthalide,
3-(p-dimethylaminophenyl)-3-(1 -p-dimethylaminophenyl-1-p-chlorophenylethylene- 2-il)-6-dimethylaminophthalide,
3-(4'-dimethylamino-2'-methoxy)-3-(1"-p-dimethylaminophenyl-1" -p-chlorophenyl- 1",3"-buthadiene-4"-il-)benzophthalide,
3-(4'-dimethylamino-2'-benzyloxy)-3-( 1"-p-dimethylaminophenyl-1"-phenyl- 1",3"-buthadiene-4"-il) benzophthalide,
3-dimethylamino-6-dimethylamino-fluorene-9 -spiro-3'(6'-dimethylamino)phthalide,
3,3-bis{ 2-(p-dimethylaminophenyl)-2 -(p-methoxyphenyl)ethenyl}-4,5,6,7-tetrachlorophthalide,
3-bis{ 1,1-bis(4-pyrolidinophenyl)ethylene- 2-il}-5,6-dichloro-4,7-diburomophthalide,
bis(p-dimethylaminostyryl)-1 -naphthalenesulfonylmethane,
bis(p-dimethylaminostylile)-1-p-tolylsulfonylmethane, etc.

The developer, contained in the recording layer of the thermal printing material of the present invention, comprises one of various electron-receptive compounds or oxidizing agents which develop the above leuco compound color when contacted. The electron-receptive compounds or oxidizing agents are known in the art. It is found that a preferred compound of the developer for use in the recording layer of the thermal printing material is 2,4'-hydroxydiphenylsulfone.

Examples of the developer, contained in the recording layer of the thermal printing material, are:
4,4'-isopropylidendiphenol,
4,4'-isopropylidenbis(o-methylphenol),
4,4'-secondary-buthylidenebisphenol,
4,4'-isopropylidenbis(2-tertiary-buthylphenol),
p-nitrozincbenzoate,
1,3,5-tris(4-tertiary-buthyl-3-hydroxy- 2,6-dimethylbenzyl-)isocyanurate,
2,2-(3,4-dihydroxydiphenyl)propane,
bis(4-hydroxy-3-methylphenyl)sulfide,
4{β-(p-methoxyphenoxy)ethoxy}salicylic acid
1,7-bis(4-hydroxyphenylthio)-3,5-dioxaheptane,
1,5-bis(4-hydroxyphenylthio)-5 -oxapentane,
monobenzylester-monocalcium phthalate,
4,4'-cyclohexylidendiphenol,
4,4'-isopropylidenbis(2-chlorophenol),
2,2'-methylenbis(4-methyl-6 -tertiarybuthylphenol),
4,4'-buthylidenbis(6-tertiarybuthyl-2 -methyl)phenol,
1,1,3-tris(2-methyl-4-hydroxy-5-tertiary buthylphenyl-)buthane,
1,1,3-tris(2-methyl-4-hydroxy-5 -cyclohexylphenyl-)buthane,
4,4'-thiobis(6-tertiarybuthyl-2 -methyl)phenol,
4,4'-dihydroxydiphenylsulfone,
4-isopropoxy-4'-hydroxydiphenylsulfone,
4-benzyloxy-4'-hydroxydiphenylsulfone,
4,4'-diphenolsulfoxyde,
isopropyl-p-hydroxybenzoate
benzyl-p-hydroxybenzoate
benzyl-protocatechuate
stearylgallate,
laurylgallate,
octylgallate,
1,3-bis(4-hydroxyphenylthio)-propane,
N,N'-diphenylthiourea,
N,N'-di(m-chlorophenyl)thiourea,
salicylanilide,
bis-(4-hydroxyphenyl)methylacetate,
bis-(4-hydroxyphenyl)benzylacetate,
1,3-bis(4-hydroxycumyl)benzene,
1,4-bis(4-hydroxycumyl)benzene,
2,4'-diphenolsulfon,
2,2'-diallyl-4,4'-diphenolsulfon,
3,4-dihydroxyphenyl-4'-methyldiphenylsulfon,
1-acetyloxy-2-zincnaphthoate,
2-acetyloxy-1-zincnaphthoate,
2-acetyloxy-3-zincnaphthoate,
α,α-bis(4-hydroxyphenyl)-α-methyltoluene,
zincthiocyanate antipyrine complex,
tetrapromobisphenol A,
tetrapromobisphenol S,
4,4'-thiobis(2-methylphenol),
4,4'-thiobis(2-chlorophenol), etc.

A typical method of forming the recording layer on the intermediate layer is the same as the above method in the case of the intermediate layer. The recording layer of the thermal printing material according to the present invention comprises a binder in addition to the leuco compound color and the developer. One of various kinds of known binder resins may be used as the binder which binds the recording layer onto the intermediate layer.

In addition, the recording layer according to the present invention further comprises a supplementary additive in addition to the above binder, as required. This supplementary additive may be selected from among fillers, thermofusible matter, surface-active agent and the like.

Examples of the fillers, which may be added to the recording layer, are: powders of inorganic compounds, such as calcium carbonate, silica, zinc oxide, titan oxide, aluminum hydroxide, zinc hydroxide, barium sulfate, clay, talc, surface-treated calcium and silica; and powders of organic compounds, such as urea-formalin resin, styrene/methacrylic acid coplymer, and polystyrene resin.

Examples of the thermo-fusible matter, which may be added to the recording layer, are: fatty acid or its ester, amido or metallic salt, wax, aromatic carboxylic acid/amine condensate, phenyl benzoate ester, high-grade straight-chain glycol, 3,4-epoxy-hexahydrophthalite-dialkyl, high-grade ketone, p-benzylbiphenyl, and the other thermo-fusible organic compounds. The melting point of the thermo-fusible matter is preferably from 50°–200° C.

In addition, in the thermal printing material according to the present invention, an additional intermediate layer between the intermediate layer and the recording layer may be formed. The additional intermediate layer contains fillers, binder, thermo-fusible matter, or the like. Examples of the fillers, the binder and the thermo-fusible matter are the same as those described above in conjunction with the recording layer and the intermediate layer.

Further, it is desirable that the thermal printing material according to the present invention further comprises a protective layer on the recording layer, in order to provide an excellent adherence to the thermal head and an increased image retention property.

Examples of the protective layer resin are: polyvinyl alcohol, cellulose derivatives, starch and its derivatives, carboxyl-group-denatured polyvinyl alcohol, polyacrylic acid and its derivatives, stylene/acrylic acid copolymer and its derivatives, poly(metha)acrylamido and its derivatives, styrene/acrylic acid/acrylamido copolymer, amino-group-denatured polyvinyl alcohol, epoxy-denatured polyvinyl alcohol, polyethylenimin, aqueous polyester, aqueous polyurethane, isobutylene/maleic anhydride copolymer and its derivatives; and polyester, polyurethane, acrylic ester base copolymer, stylene/acrylic group copolymer, epoxy resin, polyvinyl acetate, polyvinylidene chloride and its derivatives, and the like.

It is found that a protective layer comprising a water-soluble resin is preferable for use in the thermal printing material of the present invention.

In addition, the above protective layer further comprises a supplementary additive in addition to the above protective layer resin, as required. Examples of this supplementary additive are fillers, thermo-fusible matter, surface-active agent and the like, which are the same as the above described in conjunction with the recording layer.

The thermal printing material according to the present invention is produced by coating each of the respective liquids for the layers to a substrate, such as paper, plastic film and the like, and drying up the coated liquid on the substrate. In order to provide an excellent adherence of the thermal printing material to the thermal head, it is desirable to perform a calendering process for each of the intermediate layer, the recording layer and the protective layer. The degree of smoothness of each of the respective layers is determined depending on the calendering pressure applied. By performing the calendering process in this manner, it is possible to realize a thermal printing material which provides a printed image which is highly dynamic color development sensitive and does not incur a fog in the background area even when placed under a high temperature condition.

[EXAMPLES]

Next, a description will be given of various examples of the thermal printing material according to the present invention by comparison with various comparative examples.

Example 1

[Liquid A]

20 parts by weight 3-(N-methyl-3-N-cyclohexane)amino-6-methyl-7-anilinofluorane;

20 parts by weight 10% polyvinyl alcohol solution; and 60 parts by weight water.

[Liquid B]

10 parts by weight dodecane 2 acid bis[2-(2-hydroxybenzoyl)hydrazide] (the above formula II);

25 parts by weight 10% polyvinyl alcohol solution;

15 parts by weight calcium carbonate; and 50 parts by weight water.

The above Liquid A and Liquid B are respectively dispersed by using a sand mill so as to obtain an average grain diameter below 2 μm. The Liquid A and the Liquid B are mixed in a weight ratio of 1:8, and the mixture is stirred so as to obtain a recording layer forming liquid. The recording layer forming liquid is applied to a bristol board paper (the substrate), and it is dried. The bristol board paper weighs 52 grams per square meter. The recording layer forming liquid after drying weighs 7 grams per square meter. The thermal printing material (Example 1) having the recording layer formed in the above manner is produced.

Comparative Example 1

Comparative Example 1 is produced from the Liquid A and the Liquid B which are the same as described above, except that p-toluenesulfonylhydrazide is used instead of the compound represented by the formula (II) in Liquid B.

A light resistance test, a heat resistance test, and an alcohol resistance test are respectively conducted for comparative analysis of the thermal printing materials of Example 1 and Comparative Example 1. A testing procedure for each of the three tests will be described below.

(1) Light Resistance Test

The thermal printing materials of the Example 1 and the Comparative Example 1 are color developed by heating to 200° C. for 1.0 second by using a thermal tester from Toyo Seiki Company in Japan. Both the examples are exposed to Xe (xenon) light for 48 hours by use of a xenon weatherometer (Atlas Ci35A from Toyo Seiki Company). Then, an optical density of a color developed portion on each of the two examples is measured by use of Macbeth illuminometer RD-914. An image retention ratio, represented by the following formula, is calculated from the measurements of the optical densities.

*Image Retention Ratio (%)=(Optical Density After Exposure/Optical Density Before Exposure)×100*

The image retention ratios for Example 1 and Comparative Example 1 are indicated in TABLE 1 below.

(2) Heat Resistance Test

Let the recording layers of the thermal printing materials stand for 6 hours under a condition at 100° C. After this, an optical density of a background portion for each of Example 1 and Comparative Example 1 is measured by use of the Macbeth illuminometer RD-914.

The resulting optical densities of the background portions for Example 1 and Comparative Example 1 are indicated in TABLE 1 below.

(3) Alcohol Resistance Test

Each of Example 1 and Comparative Example 1 is submerged in ethyl alcohol about one minute, and they are taken out and dried up. Then, an optical density of a background portion for each of Example 1 and Comparative Example 1 is measured by use of the Macbeth illuminometer RD-914.

The resulting optical densities of the background portions for Example 1 and Comparative Example 1 are indicated in TABLE 1 below.

TABLE 1

| | BEFORE TEST IMAGE | B/G | LIGHT RESIST (%) | HEAT RESIST B/G | ALCOHOL RESIST B/G |
|---|---|---|---|---|---|
| EX 1 | 1.41 | 0.07 | 97 | 0.26 | 0.10 |
| C/E 1 | 1.38 | 0.07 | 85 | 1.11 | 0.80 |

Example 2

[Liquid A]

20 parts by weight 3-di-N-buthylamino- 6-methyl-7-anilinofluorane, 20 parts by weight 10% polyvinyl alcohol solution, and 60 parts by weight water.

[Liquid B]

10 parts by weight 2,4'-diphenolsulfone, 1.5 parts by weight the phenol compound represented by the formula (V), 1.5 parts by weight the phenol compound represented by the formula (VI), 28 parts by weight 10% polyvinyl alcohol solution, 15 parts by weight calcium carbonate, and 44 parts by weight water.

The above Liquid A and Liquid B are respectively dispersed by using a sand mill so as to obtain an average grain diameter below 2 μm.

[Liquid C]

40 parts by weight hollow particles of non-cellular plastic (solid content 24%, average grain diameter 3 μm, hollow space ratio 95%), 10 parts by weight stylene/butadiene coplymer latex (solid matter 47%), and 50 parts by weight water.

The above Liquid C is dispersed by use of a dispersion mill to obtain an intermediate layer forming liquid. The intermediate layer forming liquid is applied to a bristol board paper (weighing 60 g/m$^2$), and it is dried such that the intermediate layer forming liquid after drying weighs 6 g/m$^2$. Thus, the bristol board paper (the substrate) on which an intermediate layer is formed is obtained.

The Liquid A and the Liquid B are mixed in a weight ratio of 1:8, and the mixture is stirred so as to obtain a recording layer forming liquid. The recording layer forming liquid is applied to the above bristol board paper, and it is dried such that the recording layer forming liquid after drying weighs 7 grams per square meter. Thus, a recording layer is formed on the intermediate layer of the thermal printing material.

[Liquid D]

63 parts by weight 10% polyvinyl alcohol solution, 3 parts by weight silica, 1 part by weight zinc sterate, and 33 parts by weight water.

The Liquid D is dispersed so as to obtain a protective layer forming liquid, and it is applied to the recording layer of the bristol board paper, and it is dried such that the protective layer forming liquid after drying weighs 5 g/m$^2$. Thus, a protective layer is formed on the recording layer of the thermal printing material. Thereafter, a calendering process for the above thermal printing material under pressure 35 kg/cm$^2$ is performed, so that the thermal printing material according to the present invention is produced.

Example 3

[Liquid E]

10 parts by weight 2,4'-diphenolsulfon, 3.0 parts by weight the phenol compound represented by the formula (V), 28 parts by weight 10% polyvinyl alcohol solution, 15 parts by weight calcium carbonate, and 44 parts by weight water.

The above Liquid E is used instead of the Liquid B, and Example 3 of the thermal printing material according to the present invention is produced in the same manner as the above Example 2.

Example 4

[Liquid F]

10 parts by weight 2,4'-dihydroxydiphenylsulfone, 3.0 parts by weight the phenol compound represented by the formula (VI), 28 parts by weight 10% polyvinyl alcohol solution, 15 parts by weight calcium carbonate, and 44 parts by weight water.

The above Liquid F is used instead of the Liquid B, and Example 4 of the thermal printing material is produced in the same manner as the above Example 2.

Comparative Example 2

Comparative Example 2 is produced in the same manner from the Liquids A through D which are the same as described above, except that the phenol compounds represented by the formulas (V) and (VI) are not contained in the Liquid B.

Comparative Example 3

[Liquid G]

10 parts by weight 2,4'-dihydroxydiphenylsulfone, 3 parts by weight tetrabromobisphenol A, 28 parts by weight 10% polyvinyl alcohol solution, 15 parts by weight calcium carbonate, and 44 parts by weight water.

The above Liquid G is used instead of the Liquid B, and Comparative Example 3 is produced in the same manner as the above Example 2.

Comparative Example 4

Comparative Example 4 is produced in the same manner from the Liquids A through D which are the same as described above, except that hollow particles of non-cellular plastic with a solid content 24%, an average grain diameter 12 μm and a hollow space ratio 90% are used instead in the Liquid C.

Comparative Example 5

Comparative Example 5 is produced in the same manner from the Liquids A through D which are the same as described above, except that hollow particles of non-cellular plastic with a solid content 24%, an average grain diameter 1 μm and a hollow space ratio 80% are used instead in the Liquid C.

Comparative Example 6

Comparative Example 6 is produced in the same manner from the Liquids A through D which are the same as described above, except that 4-isopropoxy-4'-hydroxyphenylsulfon (melting point 128° C.) is used as the developer in the Liquid B.

Comparative Example 7

Comparative Example 7 is produced in the same manner from the Liquids A through D which are the same as described above, except that tetrabromobisphenol S (melting point 290° C.) is used as the developer in the Liquid B.

A static color development test, a heat resistance test, a dynamic color development sensitivity test, a light resistance test, and a water resistance test are respectively conducted for comparative evaluation of the thermal printing materials of the above Examples and the above Comparative Examples. A testing procedure for each of these evaluation tests will be described below.

(1) Static Color Development Test

The thermal printing materials are color developed under conditions of 1.0 second and 2 kg/cm$^2$ by using a thermal tester (from Toyo Seiki Company). The optical density of an image portion of each of the thermal printing materials is measured by using the Macbeth illuminometer RD-914. A color development start temperature of each of the thermal printing materials of the above Examples and the above Comparative Examples, at which each optical density is equal to 0.2, is determined based on the temperature measurements.

The resulting color development start temperatures of the examples 2 through 4 and the comparative examples 2 through 7 are indicated in TABLE 2 below.

(2) Heat Resistance Test

The testing procedure for this evaluation test is conducted in the same manner as described above.

(3) Dynamic Color Development Sensitivity Test

A print sample for each of the thermal printing materials is produced under conditions of 0.68 W/dot head power, 20 msec/line single-line printing time, 8×3.85 dots/mm$^2$ linear scanning density, 0.2–1.2 msec varied pulsewidth by using a thermal printing tester having a thin-film head (from Matsushita Electronic Parts Company in Japan). The optical density of an image portion of each of the thermal printing materials is measured by using the Macbeth illuminometer RD-914. A dynamic color development sensitivity of each of the thermal printing materials, at which the pulsewidth is equal to 1.0 msec, is determined based on the optical density measurements.

(4) Light Resistance Test

The thermal printing materials are color developed by heating to 180° C. for 1.0 second under 2 kg/cm$^2$ pressure by using the above thermal tester. Print samples for the examples and the comparative examples are produced by exposing to Xe (xenon) light for 15 hours by use of the above xenon weatherometer. An optical density of a color developed portion on each of the print samples is measured by use of the Macbeth illuminometer RD-914.

The resulting optical densities of the color developed portions of the examples and the comparative examples are indicated in TABLE 2 below.

(5) Water Resistance Test

Each of the print samples (same as those in the above light resistance test) is submerged in water about 24 hours. They are taken out from water and dried. An optical density of a color developed portion for each of the examples and the comparative examples is measured by use of the Macbeth illuminometer RD-914.

The resulting optical densities of the color developed portions for the examples and the comparative examples are indicated in TABLE 2 below.

TABLE 2

| | S/COLOR DEVEL-OPMENT (°C.) | HEAT RESIST. (100° C.) | D/COLOR DEVEL-OPMENT | WATER RESIST. (IM-AGE) | LIGHT RESIST. (IM-AGE) |
|---|---|---|---|---|---|
| EX 2 | 112 | 0.24 | 1.33 | 1.33 | 1.34 |
| EX 3 | 113 | 0.24 | 1.34 | 1.35 | 1.28 |
| EX 4 | 111 | 0.25 | 1.32 | 1.30 | 1.40 |
| C/E 2 | 115 | 0.23 | 1.36 | 1.00 | 1.03 |
| C/E 3 | 105 | 0.31 | 1.37 | 1.20 | 1.15 |
| C/E 4 | 112 | 0.23 | 1.15 | 1.34 | 1.33 |
| C/E 5 | 112 | 0.24 | 1.01 | 1.33 | 1.34 |
| C/E 6 | 92 | 0.62 | 1.39 | 1.38 | 1.01 |
| C/E 7 | 152 | 0.18 | 1.89 | 1.27 | 1.32 |

From the results shown in TABLES 1 and 2, it is found that the alcohol resistance, heat resistance, dynamic color development sensitivity, light resistance and water resistance of the thermal printing materials of the examples according to the present invention are superior to those of the comparative examples.

Further, the present invention is not limited to the above described embodiments, and variations and modifications may be made without departing from the scope of the present invention.

What is claimed is:

1. A thermal printing material having a substrate and a recording layer on the substrate, the recording layer comprising a leuco compound color and a developer for developing said leuco compound color when heated, said developer comprising a compound represented by the formula:

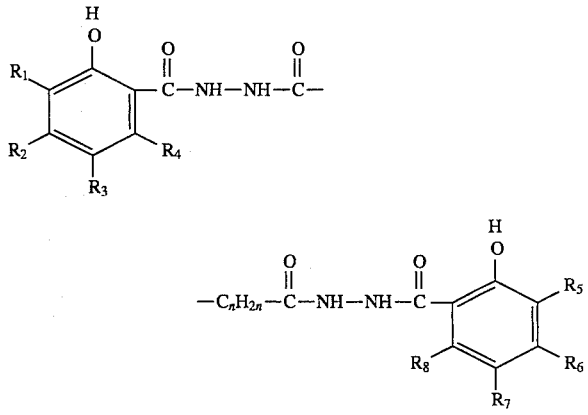

wherein each of R1 through R8 indicates a hydrogen atom or an alkyl group having from 1–5 carbon atoms, and n indicates an integer from 6–14.

2. The thermal printing material as claimed in claim 1, wherein said recording layer further comprises a phenol compound represented by the formula:

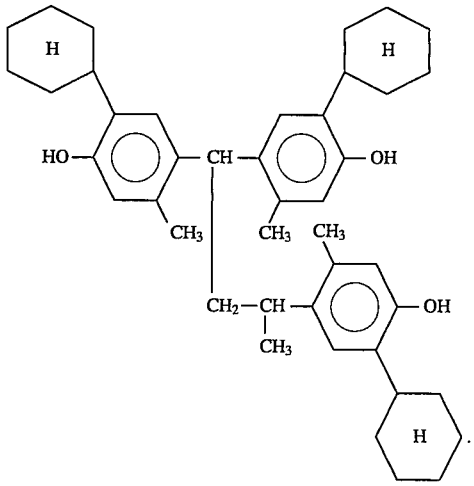

3. The thermal printing material as claimed in claim 1, wherein said recording layer further comprises a phenol compound represented by the formula:

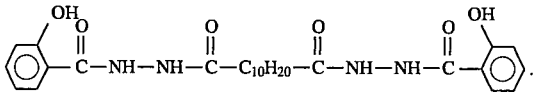

4. The thermal printing material as claimed in claim 1, wherein said developer comprises 2,4'-dihydroxydiphenylsulfone.

5. The thermal printing material as claimed in claim 1, wherein said thermal printing material has the substrate, an intermediate layer on the substrate, and the recording layer on the intermediate layer, said intermediate layer containing hollow particles of non-cellular plastic which have an average grain diameter from 2–10 μm and a hollow space ratio above 90 percent.

6. The thermal printing material as claimed in claim 5, wherein said recording layer further comprises a phenol compound represented by the formula:

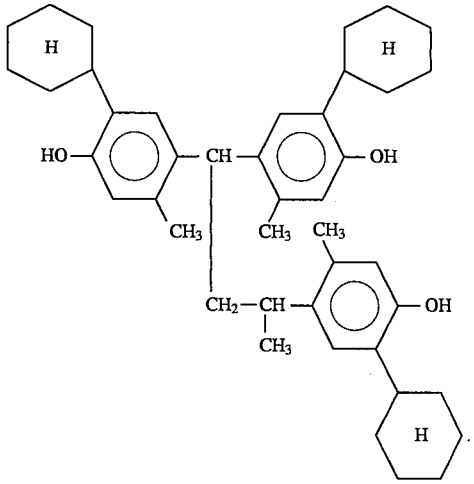

7. The thermal printing material as claimed in claim 5, wherein said recording layer further comprises a phenol compound represented by the formula:

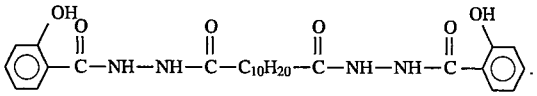

8. The thermal printing material as claimed in claim 5, wherein said developer comprises 2,4' -dihydroxydiphenylsulfone.

* * * * *